US006104347A

United States Patent [19]

Snygg et al.

[11] Patent Number: 6,104,347

[45] Date of Patent: Aug. 15, 2000

[54] ANTENNA DEVICE

[75] Inventors: Göran Snygg, Partille; Jonas Sandstedt, Göteborg, both of Sweden

[73] Assignee: Telefonaktiebolaget LM Ericsson, Stockholm, Sweden

[21] Appl. No.: 09/073,438

[22] Filed: May 6, 1998

[30] Foreign Application Priority Data

May 7, 1997 [SE] Sweden ..... 9701738

[51] Int. Cl.[7] ..... H01Q 1/38

[52] U.S. Cl. ..... 343/700 MS; 343/829; 343/846

[58] Field of Search ..... 343/700 MS, 829, 343/846; H01Q 1/38

[56] References Cited

U.S. PATENT DOCUMENTS

| | | | |
|---|---|---|---|
| 4,755,821 | 7/1988 | Itoh et al. | 343/700 MS |
| 4,857,938 | 8/1989 | Tsukamoto et al. | 343/700 MS |
| 4,903,033 | 2/1990 | Tsao et al. | 343/700 MS |
| 4,977,406 | 12/1990 | Tsukamoto et al. | 343/700 MS |
| 5,070,339 | 12/1991 | Chu et al. | 343/700 MS |
| 5,181,042 | 1/1993 | Kaise et al. | 343/700 MS |
| 5,278,569 | 1/1994 | Ohta et al. | 343/700 MS |
| 5,694,136 | 12/1997 | Westfall | 343/700 MS |

*Primary Examiner*—Don Wong
*Assistant Examiner*—Shih-Chao Chen
*Attorney, Agent, or Firm*—Burns, Doane, Swecker & Mathis, L.L.P.

[57] ABSTRACT

A device for antennas, in particular dual-polarized microwave antennas with single-polarized patches, for which antennas reduced cross-polarization and reduced cross-coupling can be achieved without impairing the bandwidth of the antenna or increasing the occurrence of grating lobes. A modification of the traditionally rectangular geometry of the single-polarized patches is carried out. The modification is symmetrical in relation to the plane in which the linear-polarized signal lies for the respective patch. The modification involves the patches narrowing towards the ends along the respective polarization axis in such a manner that side edges which face side edges of adjacent patches are formed. In this way, the coupling between adjacent patches and also the cross-polarization in the respective patch are reduced.

20 Claims, 3 Drawing Sheets

ANTENNA DEVICE

This application claims priority under 35 U.S.C. §§119 and/or 365 to SE 9701738-8 filed in Sweden on May 7, 1997; the entire content of which is hereby incorporated by reference.

The present invention relates to antennas and devices for and/or comprised in antennas, in particular dual-polarized microwave antennas for use in, for example, a base station for mobile telephony, with which reduced coupling between the antenna elements of the antenna can be brought about. The invention also relates to antennas and devices for or comprised in antennas, in particular dual-polarized microwave antennas, with which reduced cross-polarization in the antenna elements can be brought about.

BACKGROUND

The development of mobile telephony has created a need for simple and inexpensive mass production of antennas for, inter alia, base stations. In order to achieve better and more reliable coverage, which is of particular importance within mobile telephony, use is advantageously made of polarization diversity. Two different polarizations, usually at right angles to one another, are used, preferably via one and the same antenna. Mobile telephony utilizes frequency ranges which lie within the microwave range, for which reason an antenna which is often used is the microstrip antenna. Like some other microwave antennas, microstrip antennas comprise radiating antenna elements which are mounted in front of a ground plane. Dual-polarized antennas commonly found within, for example, mobile telephony are polarized using 0/90° or ±45°. Dual-polarized antennas exist in two basic variants, the first of which comprises two different types of single-polarized antenna elements in order to produce two different polarizations, and the second comprises dual-polarized antenna elements instead. Both variants of dual-polarized antennas have advantages and disadvantages. A requirement has arisen, in particular within mobile telephony, for antennas with ±45° polarization because this type of polarization appears for the time being to have more advantages, such as a more symmetrical propagation/attenuation, compared with 0/90° polarization. The present invention concerns the problems which arise with regard to single-polarized antenna elements in the form of patches above a ground plane in, for example, said types of dual-polarized antennas. The patches may be, for example, aperture-fed or probe-fed.

It is important that the two polarizations in dual-polarized antennas have antenna patterns which are as equivalent as possible and that every polarization vector maintains its direction for all azimuth angles. In order to achieve this, it is important, inter alia, that each linear-polarized antenna element, patch, is excited in only one polarization, that is to say that the cross-polarization must be kept as low as possible. A reduction of the cross-polarization in a patch can be achieved by, for example, decreasing the width of the patches. If the width of the patches is decreased, the bandwidth is also decreased and the lobe width increases.

Moreover, it is also important that the coupling between the patches for the two polarizations is as low as possible. One solution in this respect could be to increase the distance between the patches, but if the distance between patches for the same polarization is increased, problems arise with undesirable grating lobes which impair the applicability of the antenna. A dual-polarized antenna with single-polarized rectangular patches is a construction in which traditionally a compromise between bandwidth and cross-polarization and also between coupling between patches and grating lobes has been made.

SUMMARY

One object of the invention is to define a device for or comprised in antennas, in particular dual-polarized microwave antennas with single-polarized patches, for reducing the coupling between the patches without increasing the occurrence of grating lobes.

A further object of the invention is to define a device for or comprised in antennas, in particular dual-polarized microwave antennas with single-polarized patches, for reducing the cross-polarization in the patches without having to decrease the bandwidth of the antenna.

Another object of the invention is to define a single-polarized antenna element for receiving and transmitting electromagnetic signals with a linear polarization mainly within the microwave frequency range arranged at a predetermined distance from a ground plane in a dual-polarized antenna for reducing the cross-polarization in the antenna element without having to decrease the bandwidth of the antenna.

The abovementioned objects are achieved according to the invention by antennas or a device for or comprised in antennas, in particular dual-polarized microwave antennas with single-polarized patches, for which antennas reduced cross-polarization and reduced cross-coupling can be achieved without impairing the bandwidth of the antenna or increasing the occurrence of grating lobes. A modification of the traditionally rectangular geometry of the single-polarized patches is carried out. The modification is symmetrical in relation to the plane in which the linear-polarized signal lies for the respective patch. The modification involves the patches narrowing towards the ends along the respective polarization axis in such a manner that side edges which face side edges of adjacent patches are formed. In this way, the coupling between adjacent patches and also the cross-polarization in the respective patch are reduced.

According to the invention, the abovementioned objects are also achieved by means of a dual-polarized antenna for receiving and transmitting electromagnetic signals with linear polarizations mainly within the microwave frequency range. The antenna comprises a ground plane, one or more first linear-polarized antenna element(s) in the form of one or more first patches for a first linear polarization. The antenna also comprises one or more second linear-polarized antenna elements in the form of one or more second patches for a second linear polarization. Each first patch has a first polarization axis through the geometrical centre of each respective first patch and the plane in which the first linear polarization lies for the respective first patch. Each first patch also has a first transverse axis which passes through the geometrical centre of the respective first patch and is at right angles to the respective first polarization axis. Each second patch has a second polarization axis through the geometrical centre of each second patch and through the plane in which the second linear polarization lies for the respective second patch. Each second patch also has a second transverse axis which passes through the geometrical centre of the respective second patch and is at right angles to the respective second polarization axis. Each patch has an overall length which is defined as the greatest distance between the ends of the respective patch parallel to the respective polarization axis. Each patch has an overall width which is defined as the greatest distance across the patch parallel to the respective transverse axis. The ground plane comprises a first side and a second side. The antenna elements are arranged at a predetermined distance from the first side of the ground plane along a positioning line so that two patches for the same linear polarization are not adjacent. The respective first and second polarization axes of adjacent patches intersect one another outside the extent of the patches. Along a part of each first and second polarization axis from each respective geometrical centre towards the ends of the patches, each respective patch narrows in such a manner that side edges with at least one tangent per side edge are formed. The side edges face the side edges of adjacent patches, the respective tangents of which somewhere on the side edges form an angle which is preferably smaller than 80° relative to one another in order thus to reduce the coupling between adjacent patches and also the cross-polarization in the respective patch.

Suitably, the first and the second polarizations are orthogonal. In this case, the patches can suitably also be arranged so that the respective first and second polarization axes of adjacent patches intersect one another in the main orthogonally.

Suitably, the geometry of each patch can be symmetrical in relation to the respective polarization axis. The geometry of each patch can suitably also be symmetrical in relation to the respective transverse axis.

In certain embodiments of the invention, somewhere on opposite side edges belonging to adjacent patches, the tangents of the respective side edges can in the main be parallel. In certain embodiments, the patches can be arranged centred along the positioning line in such a manner that the respective geometrical centre of the patches is passed through by the positioning line.

In certain embodiments, the narrowing of each respective patch can begin at at least 1/20 of the overall length from each end, that is to say that the patch does not narrow over at most 9/10 of its overall length. Suitably, the width of the ends of the respective patch can be narrowed to not less than 1/10 of the overall width of the respective patch, that is to say that, over at least 1/10 of each end around the polarization axis, the respective patch has the overall length. It may also be suitable for the width of the ends of the respective patch to be narrowed by at least 1/10 of the overall width of the respective patch, that is to say that, over at most 9/10 of each end around the polarization axis, each respective patch has the overall length. Alternatively, in certain embodiments, it may be suitable for the width of the ends of the respective patch to be narrowed by at least 1/10 of the overall width of the respective patch and at most so that at least the tangent at a point on the respective end is in the main parallel to the transverse axis of the corresponding patch, that is to say that the patch narrows at most so that only over a region immediately surrounding the polarization axis does each patch have the overall length.

In certain embodiments, it may be suitable for each first and each second patch to be in the main geometrically identical. In most embodiments of the invention, the overall width is smaller than the overall length of each respective patch. In preferred embodiments, the geometrical shape of the periphery of each respective patch is in the main a polygon. The periphery of each respective patch may suitably be octagonal.

The various embodiments and variants may be combined as required.

According to the invention, the abovementioned objects are also achieved by means of a single-polarized antenna element for receiving and transmitting electromagnetic signals with a linear polarization mainly within the microwave frequency range.

The antenna element is arranged at a predetermined distance from a ground plane in a preferably dual-polarized antenna. The single/linear-polarized antenna element is in the form of a patch for a linear polarization. The patch has a first polarization axis through the geometrical centre of the patch and the plane in which the linear polarization lies for the patch. The patch also has a transverse axis which passes through the geometrical centre of the patch. The transverse axis is at right angles to the polarization axis. The patch has an overall length which is defined as the greatest distance between the ends of the patch parallel to the polarization axis. The patch has an overall width which is defined as the greatest distance across the patch parallel to the transverse axis. Over at least the last 1/20 of the overall length of the patch, along the polarization axis from the geometrical centre of the patch towards the ends of the patch, the patch narrows. The patch narrows in such a manner that the width of the ends of the patch is narrowed by at least 1/10 of the overall width of the patch and at most so that at least the tangent at a point on the respective end is in the main parallel to the transverse axis of the patch in order thus to reduce the cross-polarization in the patch.

According to exemplary embodiment, the overall width of the patch is smaller than the overall length of the patch. In preferred embodiments, the geometry of each patch is symmetrical in relation to the respective polarization axis. The geometry of each patch may also be symmetrical in relation to the respective transverse axis.

In exemplary embodiments, the geometrical shape of the periphery of the patch may also be in the form of a polygon, for example an octagon.

The invention has a number of advantages compared with previously known art with regard to antennas and in particular dual-polarized microwave antennas with patches above a ground plane as radiating antenna elements, such as, for example, dual-polarized microstrip antennas which use microstrip distribution networks as feeder networks for the radiating elements of the antenna. The patches according to the invention may be, for example, aperture-coupled patches or probe-fed patches. According to the invention, improved antenna characteristics are achieved by means of modifying the geometrical shape of the patches. The same centre-to-centre distance between the patches can be retained, for which reason previously designed feeder networks can be used. The external dimensions of an antenna according to the invention are not changed, for which reason weather protection, assembly equipment and manufacturing equipment can also be retained. The compatibility of the antenna elements is retained, for which reason the antenna characteristics of an existing antenna can be drastically improved according to the invention by simply exchanging the radiating elements, the patches, for antenna elements designed according to the invention. The invention partly or completely eliminates coupling between the polarizations in the different single-polarized radiating elements. This is achieved by the invention creating a greater distance between adjacent patches without increasing their centre-to-centre distance. As a mnemonic rule, it usually applies that the distance between two radiating antenna elements for the same polarization should be a maximum of 0.85 $\lambda$ so as to avoid problems with grating lobes. The cross-polarization also decreases in the various single-polarized antenna elements in an array antenna according to the invention. This means that the invention is of interest with regard to, for example, base station antennas for mobile telephone systems, which require high performance and are manufactured in great quantities.

BRIEF DESCRIPTION OF THE DRAWINGS

The invention will be described in greater detail below in a non-limiting manner for the purpose of clarification, with reference to the attached figures, in which.

DETAILED DESCRIPTION

In order to illustrate the invention, a few examples of its application are to be described in the following with reference to FIGS. 1 to 3.

Figure 1:
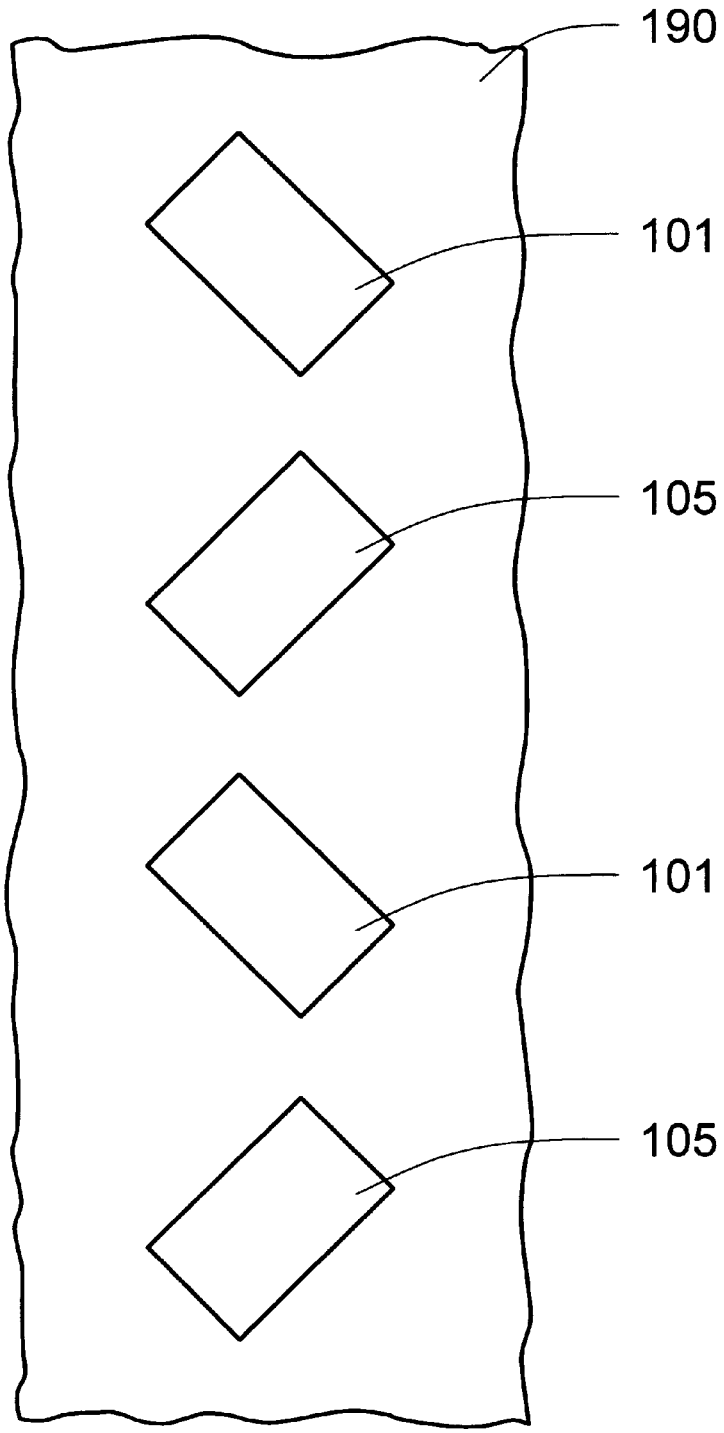
FIG. 1 PRIOR ART
FIG. 1 shows a front view of a part of a ±45° dual-polarized vertical one-dimensional array antenna with single-polarized patches.

FIG. 1 shows a front view of a part of a ±45° dual-polarized vertical one-dimensional array antenna with aperture-coupled single-polarized patches according to known art. It can be seen here that every other patch 101 is for a first polarization and every other patch 105 is for a second polarization. The patches 101, 105 lie at a predetermined distance from a ground plane 190. The geometrical positioning of the patches is in part guided by the fact that in most cases it is desirable with a wide-lobe antenna, that is to say a narrow one-dimensional array antenna. The problems with this traditional dual-polarized antenna type with single-polarized antenna elements in the form of patches are, as mentioned above, that it is necessary to compromise between bandwidth and cross-polarization and also between coupling between different patches and the occurrence of grating lobes. The antenna is therefore difficult to optimize for an individual parameter without at the same time in principle making it unusable.

Figure 2:
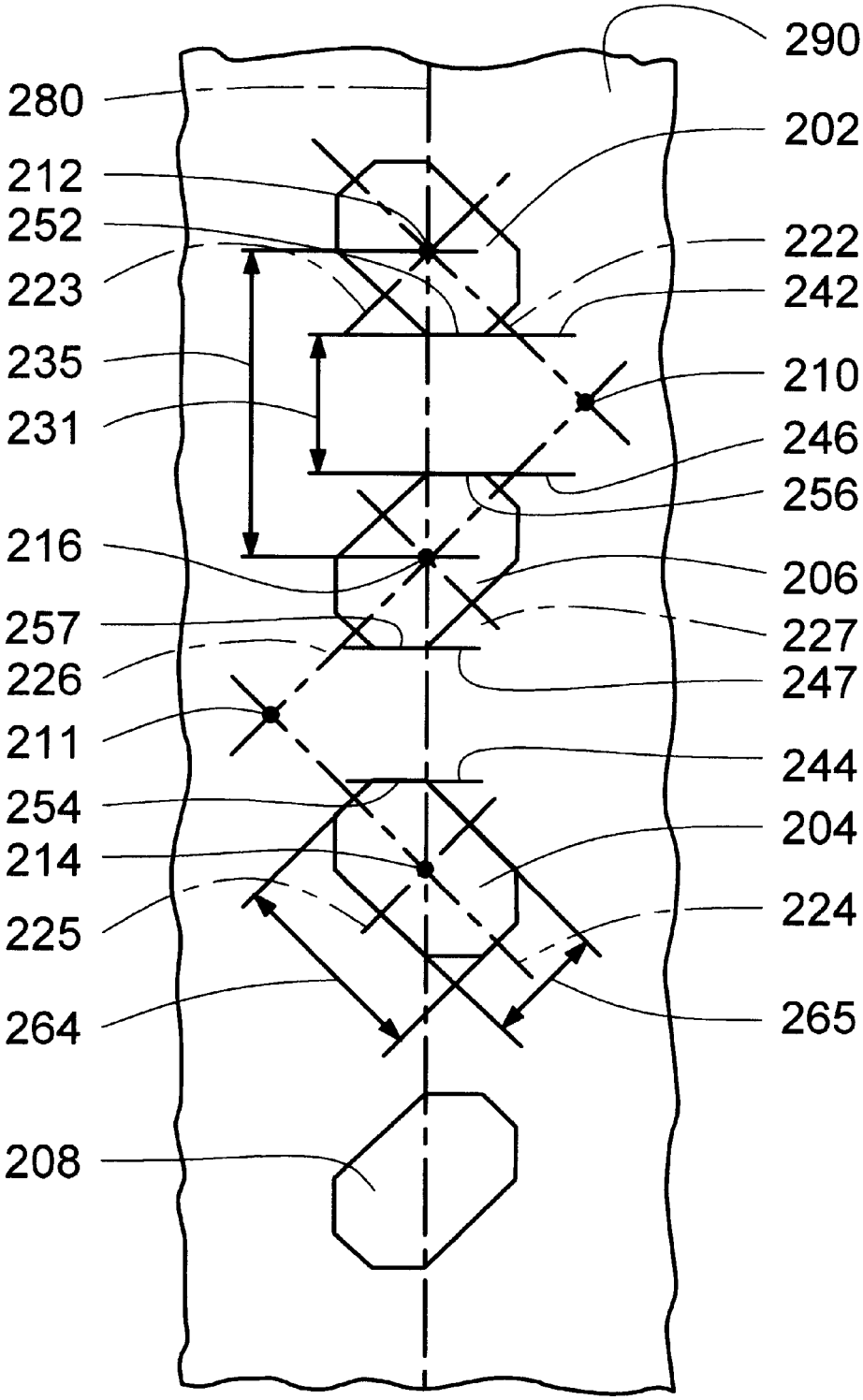
FIG. 2 shows a front view of a part of a ±45° dual-polarized vertical one-dimensional array antenna with single-polarized patches according to the invention.

FIG. 2 shows a front view of a part of a ±45° dual-polarized vertical one-dimensional array antenna with single-polarized patches 202, 204, 206, 208 according to the invention. The patches 202, 204, 206, 208 are arranged at a predetermined distance from a ground plane 290. All the patches 202, 204, 206 apart from the last patch 208 have reference lines in order to facilitate the description of the invention. Two patches 202, 204 are for a first polarization and two patches 206, 208 are for a second polarization. As is usual, every other patch is for the first polarization and every other is for the second polarization. Each patch 202, 204, 206 has a respective polarization axis 222, 224, 226 which passes through the respective geometrical centre 212, 214, 216 of each patch. Each respective polarization axis 222, 224, 226 shows how each patch 202, 204, 206 is polarized. Each patch 202, 204, 206 also has a respective transverse axis 223, 225, 227. Each respective transverse axis 223, 225, 227 passes through the respective geometrical centre 212, 214, 216 of each patch. The patches 202, 204, 206, 208 have an overall length 264, illustrated here on only one patch 204, which is defined as the length of each patch along each respective polarization axis 222, 224, 226. For this type of patch, it is usual for the overall length of the patches to be of the order of size of ⅓ to ½ λ (wavelength). The patches also have an overall width 265, illustrated here on only one patch 204, which is defined as the width of each patch along each respective transverse axis 223, 225, 227. For this type of patch, it is usual that the overall width of the patches is of the order of size of 0.8 times the overall length of the patches.

The patches 202, 204, 206, 208 are arranged around a positioning line 280, and preferably the patches 202, 204, 206, 208 are arranged in such a manner that the geometrical centre 212, 214, 216 of the respective patch is on the positioning line 280. The patches 202, 204, 206, 208 are arranged in such a manner that the respective polarization axes 222, 224, 226 intersect one another outside the geometrical extent of the patches at intersection points 210, 211. As dual-polarized antennas are usually designed for orthogonal polarizations, that is to say that the first and the second polarizations are at right angles with respect to one another, the patches 202, 204, 206, 208 are arranged, for example, in such a manner that the polarization axes 222, 224, 226 are at least in the main orthogonal at the intersection points 210, 211.

According to the invention, the geometrical shape of the patches 202, 204, 206, 208 is modified in such a manner that each patch narrows towards its respective ends. Expressed in simple terms, the corners of each patch 202, 204, 206, 208 are cut off, for example, in such a manner that each patch 202, 204, 206, 208 is symmetrical in relation to its respective polarization axis 222, 224, 226 and also symmetrical in relation to its respective transverse axis 223, 225, 227. In this way, the distance 231 between the patches 202, 206 increases without the distance 235 between the geometrical centres 212, 216 of the patches increasing. This results in the coupling between adjacent patches 202, 204, 206, 208 decreasing without the occurrence of grating lobes being affected. The narrowing also means that the antenna pattern of each patch is improved by virtue of the shape reducing the cross-polarization in each patch without reducing the overall width 265, and thus the bandwidth, of the patches.

The narrowing is carried out in such a manner that side edges 252, 254, 256, 257 are formed. Each side edge 252, 254, 256, 257 has one or more respective tangents 242, 244, 246, 247 depending on how the side edges are shaped. If the side edges 252, 254, 256, 257 are shaped according to FIG. 2, each side edge 252, 254, 256, 257 has only one respective tangent 242, 244, 246, 247, and if the side edges have a number of corners then each side edge has a number of tangents 242, 244, 246, 247. Preferably, at least one tangent 242, 247 on a side edge 252, 257 is in the main parallel to at least one tangent 244, 246 on an opposite side edge 254, 256 belonging to an adjacent patch. In certain embodiments, the side edges may be shaped in such a manner that the tangents of opposite adjacent side edges are not in the main parallel but form a different angle between them which, however, should always be smaller than 80° (in relation to the patches).

The narrowing on both sides of the transverse axis of the patch suitably begins somewhere between 1/20 and 9/20 of the overall length from the transverse axis of the patch towards the two ends. In certain embodiments, it is possible for the narrowing to begin in such a manner that only one tangent, in the main at the transverse axis, on each side of the patch is parallel to the polarization axis of the patch. Suitably, the narrowing on both sides of the polarization axis of the patch at each end ends somewhere between 1/20 and 9/20 of the total width from the polarization axis of the patch. In certain embodiments, it is possible for the narrowing to end in such a manner that only one tangent, in the main at the polarization axis, on each side of the patch is parallel to the transverse axis of the patch.

Figure 3A:
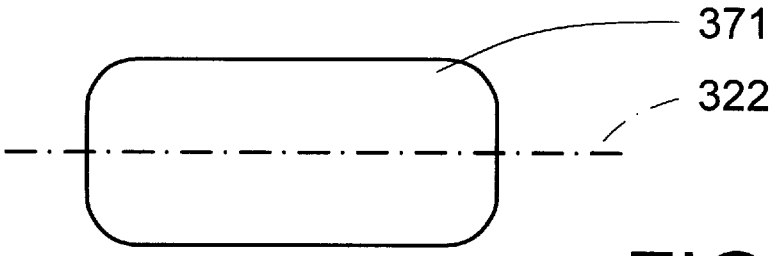
FIGS. 3A–D show examples of patches according to the invention.

FIGS. 3A–D show examples of patches according to the invention. FIGS. 3A–D show only the patches 371, 372, 373, 374 with their respective polarization axes 322. FIG. 3A shows a variant of a patch 371 according to the invention with a surface area having a geometrical shape corresponding to an ice hockey rink, in contrast to the way in which a traditional patch is shaped, the shape of the surface area of which can be compared to a football pitch. It can be seen here that those parts of the patch that narrow are curves. According to an exemplary embodiment, the curves are segments of a circle with a predetermined radius which originates from a point somewhere on the patch for each segment of a circle. The basis of this embodiment is that the periphery consists of four straight segments interconnected with four curved segments where none of the straight segments are interconnected with one another. With this embodiment, it is possible that the width of the patch decreases in such a manner that each end has only a point where the tangent is at right angles to the polarization axis 322. This means that the patch consists of only two straight segments along the polarization axis 322 interconnected by two semi-circular segments.

Figure 3B:
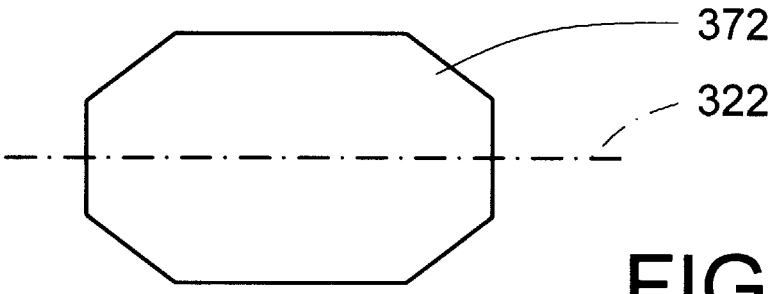

FIG. 3B shows a patch 372 according to the invention, which in the main corresponds to the patches according to FIG. 2. The geometrical shape of the surface area has a periphery which corresponds to a polygon, in this case an octagon.

Figure 3C:
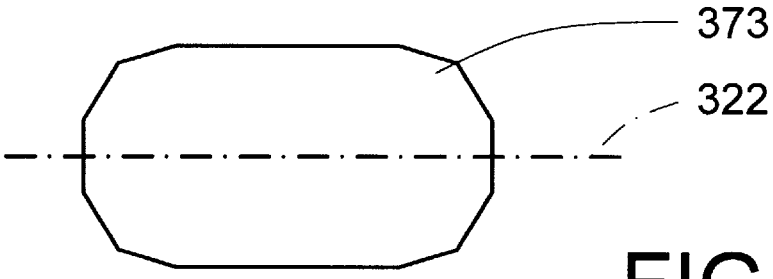

FIG. 3C shows a patch 373 according to the invention with a surface area with a geometrical shape of which the periphery corresponds to a polygon. The periphery of the patch according to FIG. 3C is a dodecagon which thus has more corners than the patches according to both FIGS. 2 and 3B.

Figure 3D:
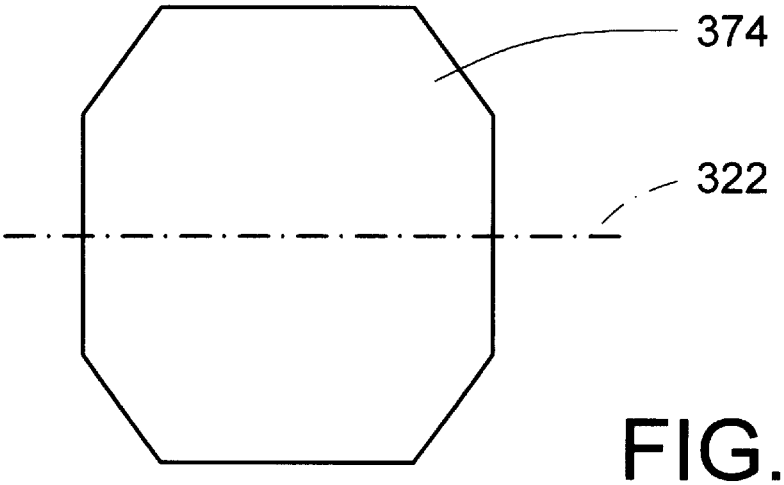

FIG. 3D shows a patch 374 according to the invention where the overall width is greater than the overall length. In certain antennas, it may be desirable to have a bandwidth and/or lobe width which requires an overall width of the patch which exceeds the overall length.

The invention relates to antennas and in particular dual-polarized microwave antennas with single-polarized radiating antenna elements in the form of patches above a ground plane, such as microstrip antennas, and a modification of the geometrical shape of the patches. It has been shown above how a geometrical modification of single-polarized patches which is symmetrical in relation to the plane in which the linear-polarized signal lies for each patch improves antenna performance through better antenna diagrams and lower coupling between the patches.

The invention is not limited to the embodiments described above but can be varied within the scope of the patent claims below.

101 antenna element for first polarization
105 antenna element for second polarization
190 ground plane
202 patch 1, for first polarization
204 patch 3, for first polarization
206 patch 2, for second polarization
208 patch 4, for second polarization
210 intersection of polarization axes for patch 1 & 2
211 intersection of polarization axes for patch 2 & 3
212 geometrical centre of patch 1
214 geometrical centre of patch 3
216 geometrical centre of patch 2
222 polarization axis of patch 1
223 transverse axis of patch 1
224 polarization axis of patch 3
225 transverse axis of patch 3
226 polarization axis of patch 2
227 transverse axis of patch 2
231 shortest distance between patches
235 centre distance between patches
242 tangent of side edge 252 patch 1
244 tangent of side edge 254 patch 3
246 tangent of side edge 256 patch 2
247 tangent of side edge 257 patch 2
252 side edge down patch 1 towards side edge 256
254 side edge up patch 3 towards side edge 257
256 side edge up patch 2 towards side edge 252
257 side edge down patch 2 towards side edge 254
264 length of a patch
265 width of a patch
280 positioning line
290 ground plane
322 polarisation axes
371 ice-hockey rink patch
372 polygonal patch with corners cut off
373 polygonal patch
374 wide polygonal patch

What is claimed is:

1. A dual-polarized antenna for receiving and transmitting electromagnetic signals with linear polarizations mainly within the microwave frequency range, which antenna comprises a ground plane, one or more first linear-polarized antenna element(s) in the form of one or more first patches for a first linear polarization and one or more second linear-polarized antenna elements in the form of one or more second patches for a second linear polarization, each first patch having a first polarization axis through the geometrical centre of each respective first patch and the plane in which the first linear polarization lies for the respective first patch, each first patch also having a first transverse axis which passes through the geometrical centre of the respective first patch and is at right angles to the respective first polarization axis, each second patch having a second polarization axis through the geometrical centre of each second patch and through the plane in which the second linear polarization lies for the respective second patch, each second patch also has a second transverse axis which passes through the geometrical centre of the respective second patch and is at right angles to the respective second polarization axis, where each patch has an overall length which is defined as the greatest distance between the ends of the respective patch parallel to the respective polarization axis and where each patch has an overall width which is defined as the greatest distance across the patch parallel to the respective transverse axis, the ground plane comprising a first side and a second side and the antenna elements being arranged at a predetermined distance from the first side of the ground plane along a positioning line so that two patches for the same linear polarization are not adjacent and the respective first and second polarization axes of adjacent patches intersect one another outside the extent of the patches, wherein, along a part of each first and second polarization axis from each respective geometrical centre towards the ends of the patches, each respective patch narrows in such a manner that side edges with at least one tangent are formed, which side edges face the side edges of adjacent patches, the respective tangents of which somewhere on the side edges form an angle which is smaller than 80° relative to one another in order thus to reduce the coupling between adjacent patches and also the cross-polarization in the respective patch.

2. The dual-polarized antenna according to claim 1, wherein the first and the second polarizations are orthogonal and in that the respective first and second polarization axes of adjacent patches intersect one another in the main orthogonally.

3. The dual-polarized antenna according to claim 1, wherein the geometry of each patch is symmetrical in relation to the respective polarization axis.

4. The dual-polarized antenna according to claim 1, wherein the geometry of each patch is symmetrical in relation to the respective transverse axis.

5. The dual-polarized antenna according to claim 1, wherein somewhere on opposite side edges belonging to adjacent patches the tangents of the respective side edges are in the main parallel.

6. The dual-polarized antenna according to claim 1, wherein the patches are arranged centred along the positioning line in such a manner that the respective geometrical centre of the patches is passed through by the positioning line.

7. The dual-polarized antenna according to claim 1, wherein the narrowing of each respective patch begins at at least 1/20 of the overall length from each end.

8. The dual-polarized antenna according to claim 1, wherein the width of the ends of the respective patch is narrowed to not less than 1/10 of the overall width of the respective patch.

9. The dual-polarized antenna according to claim 1, wherein the width of the ends of the respective patch is narrowed by at least 1/10 of the overall width of the respective patch.

10. The dual-polarized antenna according to claim 1, wherein the width of the ends of the respective patch is narrowed by at least 1/10 of the overall width of the respective patch and at most so that at least the tangent at a point on the respective end is in the main parallel to the transverse axis of the corresponding patch.

11. The dual-polarized antenna according to claim 1, wherein each first and each second patch are in the main geometrically identical.

12. The dual-polarized antenna according to claim 1, wherein the overall width is smaller than the overall length of each respective patch.

13. The dual-polarized antenna according to claim 1, wherein the geometrical shape of the periphery of each respective patch is in the main in the form of a polygon.

14. The dual-polarized antenna according to claim 13, wherein the periphery of each respective patch is octagonal.

15. A single-polarized antenna element for receiving and transmitting electromagnetic signals with a linear polarization mainly within the microwave frequency range, arranged at a predetermined distance from a ground plane in an antenna, which single-polarized antenna element is in the form of a patch for a linear polarization, the patch having a polarization axis through the geometrical centre of the patch and the plane in which the linear polarization lies for the patch, the patch also having a transverse axis which passes through the geometrical centre of the patch and is at right angles to the polarization axis, the patch having an overall length which is defined as the greatest distance between the ends of the patch parallel to the polarization axis and the patch having an overall width which is defined as the greatest distance across the patch parallel to the transverse axis, wherein, over at least the last 1/20 of the overall length of the patch, along the polarization axis from the geometrical centre towards the ends of the patch, the patch narrows in such a manner that the width of the ends of the patch is narrowed by at least 1/10 of the overall width of the patch and at most so that at least the tangent at a point on the respective end is in the main parallel to the transverse axis of the patch in order thus to reduce the cross-polarization in the patch.

16. The single-polarized antenna element according to claim 15, wherein the overall width of the patch is smaller than the overall length of the patch.

17. The single-polarized antenna element according to claim 15, wherein the geometry of each patch is symmetrical in relation to the respective polarization axis.

18. The single-polarized antenna element according to claim 15, wherein the geometry of each patch is symmetrical in relation to the respective transverse axis.

19. The single-polarized antenna element according to claim 15, wherein the geometrical shape of the periphery of the patch is in the main in the form of a polygon.

20. The single-polarized antenna element according to claim 19, wherein the periphery of the patch is octagonal.

* * * * *